US008988308B2

(12) United States Patent
Jidhage et al.

(10) Patent No.: US 8,988,308 B2
(45) Date of Patent: Mar. 24, 2015

(54) WIRELESS COMMUNICATION NODE WITH ANTENNA ARRANGEMENT FOR DUAL BAND RECEPTION AND TRANSMISSION

(71) Applicant: Telefonaktiebolaget L M Ericsson (publ), Stockholm (SE)

(72) Inventors: Henrik Jidhage, Molndal (SE); Dag Johansson, Goteborg (SE); Rolf Sihlbom, Vastra Frolunda (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 258 days.

(21) Appl. No.: 13/645,857

(22) Filed: Oct. 5, 2012

(65) Prior Publication Data

US 2014/0062834 A1 Mar. 6, 2014

Related U.S. Application Data

(63) Continuation of application No. PCT/EP2012/069524, filed on Oct. 3, 2012.

(60) Provisional application No. 61/694,397, filed on Aug. 29, 2012.

(51) Int. Cl.

| | |
|---|---|
| ***H01Q 21/00*** | (2006.01) |
| ***H01Q 21/24*** | (2006.01) |
| ***H01Q 1/24*** | (2006.01) |
| ***H01Q 5/00*** | (2006.01) |
| *H01Q 3/30* | (2006.01) |

(52) U.S. Cl.

CPC ..... *H01Q 21/24* (2013.01); *H01Q 1/246* (2013.01); *H01Q 5/002* (2013.01); *H01Q 3/30* (2013.01)

USPC ..... 343/893; 342/368; 342/372; 342/373

(58) Field of Classification Search

CPC ..... H01Q 1/246; H01Q 3/30; H01Q 5/002; H01Q 21/24

USPC ..... 343/893; 342/372, 373, 368

See application file for complete search history.

(56) References Cited

U.S. PATENT DOCUMENTS

| | | | | |
|---|---|---|---|---|
| 7,038,621 | B2 * | 5/2006 | Gabriel et al. | 342/372 |
| 7,538,740 | B2 * | 5/2009 | Korisch et al. | 343/844 |

(Continued)

FOREIGN PATENT DOCUMENTS

| | | | |
|---|---|---|---|
| WO | 2008020178 | A1 | 2/2008 |
| WO | 2011124180 | A2 | 10/2011 |

OTHER PUBLICATIONS

International Search Report from PCT/EP2012/069524; dated Apr. 18, 2013, 5 pages.

*Primary Examiner* — Hoang V Nguyen

(74) *Attorney, Agent, or Firm* — Rothwell, Figg, Ernst & Manbeck, P.C.

(57) ABSTRACT

This disclosure relates to a network node comprising an antenna arrangement with an antenna column. The antenna column comprises a first and second set of subarrays with at least two subarrays each. Each subarray comprises at least one antenna element. The first and second set of subarrays comprise antenna elements having a first polarization and antenna elements having a second polarization, orthogonal to the first polarization, respectively. Each set of subarrays is connected to a corresponding filter device via a corresponding phase altering device. Each filter device is arranged to separate signals at a first frequency band and signals at the second frequency band between respective combined ports and respective filter ports such that first filter ports are arranged for transmission and reception of signals at one frequency band, and second filter ports are arranged for reception of signals at the other frequency band.

11 Claims, 2 Drawing Sheets

(56) References Cited

U.S. PATENT DOCUMENTS

| | | | | |
|---|---|---|---|---|
| 7,843,387 | B2 * | 11/2010 | Shamsaifar et al. | 342/373 |
| 8,269,668 | B2 * | 9/2012 | Barker et al. | 342/372 |
| 2004/0051677 | A1 | 3/2004 | Gottl | |
| 2005/0179610 | A1 | 8/2005 | Le et al. | |
| 2009/0066595 | A1 | 3/2009 | Barker et al. | |

* cited by examiner

WIRELESS COMMUNICATION NODE WITH ANTENNA ARRANGEMENT FOR DUAL BAND RECEPTION AND TRANSMISSION

This application claims the benefit of U.S. Provisional Patent Application No. 61/694,397 filed on Aug. 29, 2012; this application is also a continuation of International Patent Application No. PCT/EP2012/069524, filed on Oct. 3, 2012, which designates the U.S. The above identified applications are incorporated by reference herein.

TECHNICAL FIELD

This disclosure relates to a node in a wireless communication network, where the node comprises an antenna arrangement. The antenna arrangement in turn comprises at least one antenna column, where each antenna column comprises a first set of subarrays and a second set of subarrays. Each set of subarrays comprises at least two subarrays, and each subarray in turn comprises at least one antenna element. The first set of subarrays comprises antenna elements having a first polarization and the second set of subarrays comprises antenna elements having a second polarization, where the first polarization and the second polarization are mutually orthogonal.

BACKGROUND

In a wireless communication networks, there are communication nodes, for example base stations. The base stations normally comprise sector-covering antenna arrangements. Such an antenna arrangement comprises a number of antenna ports corresponding to branches for uplink and downlink, where downlink denotes transmission, TX, from the base station to other nodes such as mobile terminals, and uplink denotes reception, RX, to the base station from other nodes such as mobile terminals. A downlink branch is thus a TX branch and an uplink branch is thus an RX branch.

Normally a typical system configuration may comprise two TX branches in the form of transmission channels and two RX branches in the form of reception channels, but system configurations with two TX branches and four RX branches are more attractive since the additional two RX branches provide large uplink improvements for a relatively small cost and volume increase. However, two additional antenna ports are required in the antenna arrangement.

An even more complex antenna arrangement is required when two TX and four RX branches on a frequency band shall be combined with two TX and four RX branches from another frequency band.

The most common configuration existing today for such a dual-band antenna arrangement, with two TX branches and four RX branches, is a dual-column antenna with individual tilt for all antenna ports and frequencies. This can be accomplished by placing diplexers after the antenna elements and having individual phase shifters for each frequency band and polarization.

Existing solutions for such a dual-band antenna arrangement, with two TX branches and four RX branches, based on compact dual column antennas, thus require one diplexer per antenna subarray and polarization. For example, a standard antenna may feature 4-9 subarrays and two polarizations per antenna column. This means that dual column antenna contains 16-36 diplexers and 8 phase shifters. It is a problem to be able to fit all these components without adding a significant volume increase of the antenna, especially for bands with a small frequency separation.

There is thus a need for a less complicated dual-band antenna arrangement in a node, where the antenna arrangement in its least complicated form has two transmission channels and four reception channels. In a typical case, the antenna arrangement has four transmission channels and eight reception channels.

SUMMARY

It is one object of some embodiments to provide a dual-band antenna arrangement in a node, where the antenna arrangement at least has two transmission channels and four reception channels, and where the dual-band antenna arrangement is less complicated than what is previously known.

The object is obtained, in some embodiments, by means of a node in a wireless communication network, where the node comprises an antenna arrangement. The antenna arrangement in turn comprises at least one antenna column, where each antenna column comprises a first set of subarrays and a second set of subarrays. Each set of subarrays comprises at least two subarrays, and each subarray in turn comprises at least one antenna element. The first set of subarrays comprises antenna elements having a first polarization and the second set of subarrays comprises antenna elements having a second polarization, where the first polarization and the second polarization are mutually orthogonal. Each first set of subarrays is connected to a corresponding first filter device via a first corresponding phase altering device, and each second set of subarrays is connected to a corresponding second filter device via a second corresponding phase altering device. Each filter device has a respective combined port connected to the corresponding phase altering device and being associated with signals at a first frequency band and signals at a second frequency band. These frequency bands are spectrally separated from each other. Each filter device further has a respective first filter port and a respective second filter port. Each filter device is arranged to separate signals at the first frequency band and signals at the second frequency band between the respective combined port and the respective filter ports such that each first filter port is arranged for transmission and reception of signals at one frequency band, and each second filter port is arranged for reception of signals at the other frequency band.

According to an example, the node comprises a first antenna column and a second antenna column which are physically separated from each other.

According to another example, for each antenna column, the first filter ports are connected to different transmission channels.

According to another example, there is a first transmission channel and a second transmission channel. The first transmission channel is associated with the first polarization and the second transmission channel is associated with the second polarization.

According to another example, for each antenna column, the first filter ports are connected to different reception channels and the second filter ports are connected to different reception channels.

More examples are disclosed in the dependent claims.

A number of advantages are obtained by means of the embodiments. Mainly a less complicated dual-band antenna arrangement is obtained, where the antenna arrangement in its least complicated form has two transmission channels and four reception channels. In a typical case, the antenna arrangement has four transmission channels and eight reception channels.

BRIEF DESCRIPTION OF THE DRAWINGS

Embodiments will now be described more in detail with reference to the appended drawings, where.

DETAILED DESCRIPTION

Figure 1:
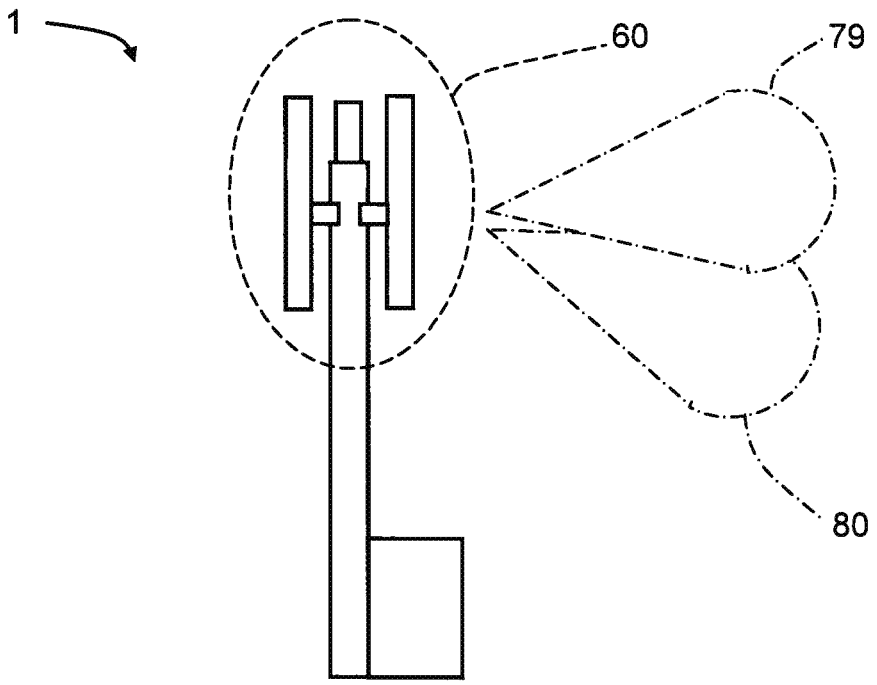
FIG. 1 shows a schematic side view of a node in a wireless communication network.

With reference to FIG. 1, there is a node 1 in a wireless communication network, the node comprising an antenna arrangement 60.

Figure 2:
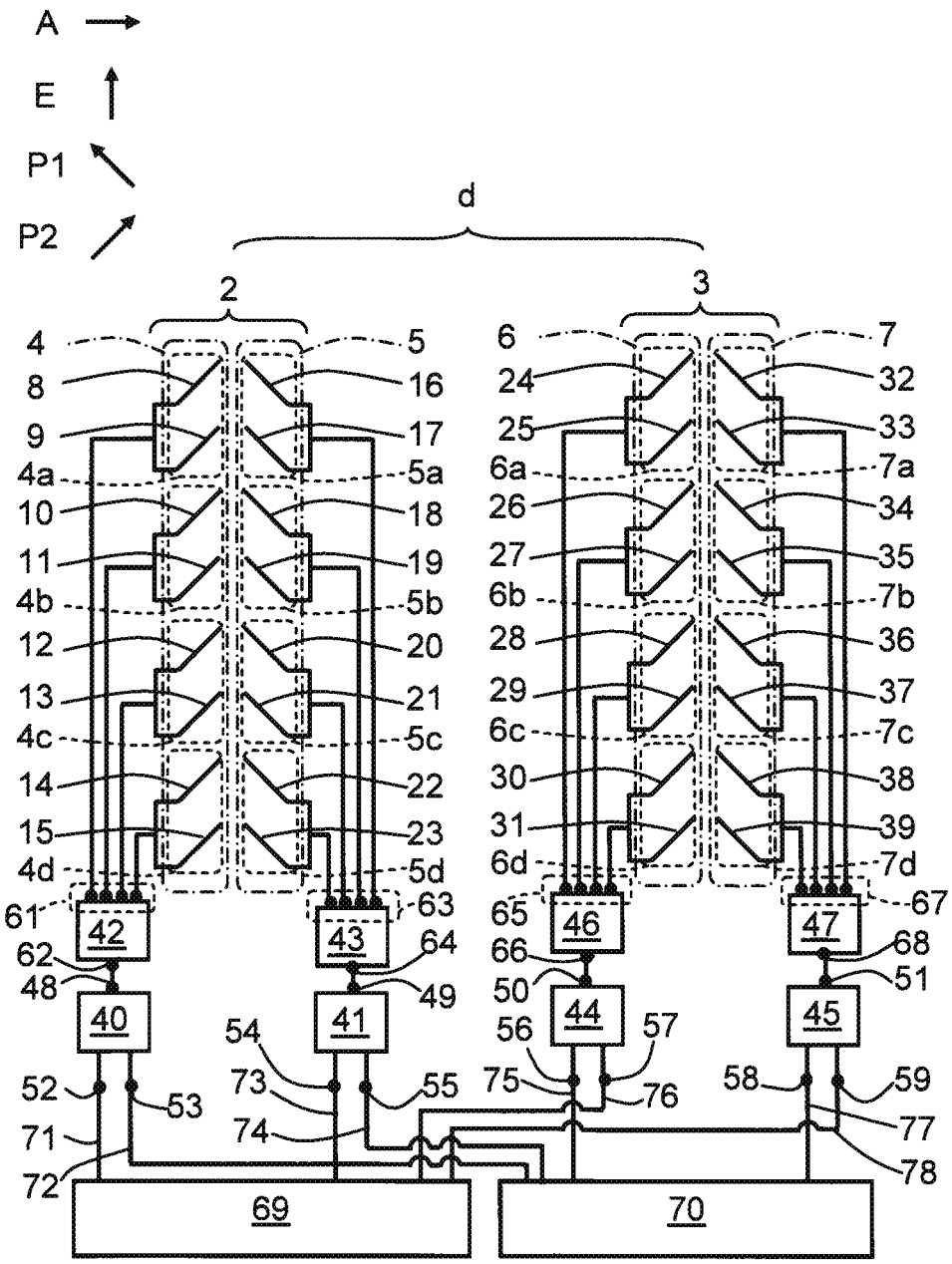
FIG. 2 shows a schematic view of an antenna arrangement according to some embodiments.

With reference to FIG. 2, the antenna arrangement 60 comprises a first antenna column 2 and a second antenna column 3. The antenna columns 2, 3 are physically separated from each other by a distance d in an azimuth direction A and have respective main extensions in an elevation direction E, where the azimuth direction A and the elevation direction E are mutually orthogonal. The antenna columns 2, 3 are arranged to radiate and/or receive signals by means of antenna radiation lobes 79, 80 in a well-known manner, as schematically indicated with dash-dotted lines in FIG. 1.

Each antenna column 2, 3 comprises a corresponding first set of subarrays 4; 6 and a corresponding second set of subarrays 5; 7. Each set of subarrays 4, 5, 6, 7 is indicated with a dash-dotted line.

The first set of subarrays 4 of the first antenna column 2 comprises four sub-arrays 4*a*, 4*b*, 4*c*, 4*d* and the second set of subarrays 5 of the first antenna column 2 comprises four further sub-arrays 5*a*, 5*b*, 5*c*, 5*d*. Each subarray of the first set of subarrays 4 of the first antenna column 2 comprises two antenna elements 8, 9; 10, 11; 12, 13; 14, 15 having a first polarization P1. Furthermore, each subarray of the second set of subarrays 5 of the first antenna column 2 comprises two corresponding antenna elements 16, 17; 18, 19; 20, 21; 22, 23 having a second polarization P2, where the first polarization P1 and the second polarization P2 are mutually orthogonal.

In the same way, the first set of subarrays 6 of the second antenna column 3 comprises four sub-arrays 6*a*, 6*b*, 6*c*, 6*d* and the second set of subarrays 7 of the second antenna column 3 comprises four further sub-arrays 7*a*, 7*b*, 7*c*, 7*d*. Each subarray of the first set of subarrays 6 of the second antenna column 3 comprises two antenna elements 24, 25; 26, 27; 28, 29; 30, 31 having the first polarization P1. Furthermore, each subarray of the second set of subarrays 7 of the second antenna column 3 comprises two corresponding antenna elements 32, 33; 34, 35; 36, 37; 38, 39 having the second polarization P2. Each sub-array 4*a*, 4*b*, 4*c*, 4*d*; 5*a*, 5*b*, 5*c*, 5*d*; 6*a*, 6*b*, 6*c*, 6*d*, 7*a*, 7*b*, 7*c*, 7*d* is indicated with a dashed line.

According to some embodiments, the first set of subarrays 4 of the first antenna column 2 is connected to a first diplexer 40 via a first phase shifter 42, the first phase shifter 42 thus having four antenna side ports 61, indicated schematically with a dashed line, connected to the first set of subarrays 4 of the first antenna column 2, and one diplexer side port 62 connected to a combined port 48 of the first diplexer 40. The first diplexer 40 in turn further comprises a first filter port 52 and a second filter port 53.

In the same way, the second set of subarrays 5 of the first antenna column 2 is connected to a second diplexer 41 via a second shifter 43, the second phase shifter 43 thus having four antenna side ports 63, indicated schematically with a dashed line, connected to the first set of subarrays 5 of the first antenna column 2, and one diplexer side port 64 connected to a combined port 49 of the second diplexer 41. The second diplexer 41 in turn further comprises a first filter port 54 and a second filter port 55.

The second antenna column 3 comprises a corresponding arrangement which will be described more briefly. The second antenna column 3 comprises a third diplexer 44, having a combined port 50, a first filter port 56 and a second filter port 57, the second antenna column 3 further comprising a fourth diplexer 45 having a combined port 51, a first filter port 58 and a second filter port 59. The combined ports 50, 51 are connected to corresponding third and fourth phase shifters 46, 47 via corresponding diplexer side ports 65, 67 at the phase shifters 46, 47. Each of the third and fourth phase shifter 46, 47 is further connected to corresponding subarrays 6*a*, 6*b*, 6*c*, 6*d*; 7*a*, 7*b*, 7*c*, 7*d* via corresponding four antenna side ports 66, 68, indicated schematically with dashed lines.

The combined ports 48, 49, 50, 51 of the diplexers 40, 41; 44, 45 are associated with signals at a first frequency band $f_1$ and signals at a second frequency band $f_2$, where the frequency bands $f_1$, $f_2$ are spectrally separated from each other. More in detail, the combined ports 48, 49, 50, 51 of the diplexers 40, 41; 44, 45 are arranged for reception and transmission of signals at the first frequency band $f_1$ and the second frequency band $f_2$.

The diplexers 40, 41; 44, 45 are in a known way arranged to separate signals at the first frequency band $f_1$ and signals at the second frequency band $f_2$ between the respective combined port 48, 49, 50, 51 and the respective filter ports 52, 53, 54, 55; 56, 57, 58, 59 such that each first filter port 52, 54; 56, 58 is arranged for transmission and reception of signals at one frequency band $f_1$, $f_2$, and each second filter port 53, 55; 57, 59 is arranged for reception of signals at the other frequency band $f_2$, $f_1$. As an example, if each first filter port 52, 54; 56, 58 is arranged for transmission and reception of signals at the first frequency band $f_1$, each second filter port 53, 55; 57, 59 is arranged for reception of signals at the second frequency band $f_2$.

The filter ports 52, 53; 54, 55; 56, 57; 58, 59 also constitute antenna ports, since these ports 52, 53; 54, 55; 56, 57; 58, 59 are an interface to the antenna columns 2, 3.

Since the phase shifters 42, 43; 46, 47 are positioned between the diplexers 40, 41; 44, 45 and the antenna elements 8, 9; 10, 11; 12, 13; 14, 15; 16, 17; 18, 19; 20, 21; 22, 23; 24, 25; 26, 27; 28, 29; 30, 31; 32, 33; 34, 35; 36, 37; 38, 39, only four diplexers and four phase shifters are needed in this example instead of 16-32 diplexers and 8 phase shifters, as mentioned initially.

The first filter ports 52, 54; 56, 58 are connected to a first transceiver device 69 via a corresponding first branch 71, third branch 73, fifth branch 75 and seventh branch 77. In the same way, the second filter ports 53, 55; 57, 59 are connected to a second transceiver device 70 via a corresponding second branch 72, fourth branch 74, sixth branch 76 and eighth branch 78. The first transceiver device 69 is arranged for reception and transmission at the first frequency band $f_1$, and the second transceiver device 70 is arranged for reception and transmission at the second frequency band $f_2$.

The first filter ports 52, 54; 56, 58 are further arranged for both transmission and reception. Each one of the first branch 71 and the fifth branch 75 is connected to a first transmission channel TX1 and to a first reception channel RX1. Furthermore, each one of the third branch 73 and the seventh branch 77 is connected to a second transmission channel TX2 and to a second reception channel RX2.

In this way, the first branch 71 is connected to the first transmission channel TX1 and to the first reception channel RX1 at the first frequency band $f_1$ and the third branch 73 is connected to the second transmission channel TX2 and to the second reception channel RX2 at the first frequency band $f_1$. Furthermore, the fifth branch 75 is connected to the first transmission channel TX1 and to the first reception channel RX1 at the second frequency band $f_2$, and the seventh branch 77 is connected to the second transmission channel TX2 and to the second reception channel RX2 at the second frequency band $f_2$.

The second filter ports 53, 55; 57, 59 are arranged for reception. Each one of the second branch 72 and the sixth branch 76 is connected to a third reception channel RX3, and each one of the fourth branch 74 and the eighth branch 78 is connected to a fourth reception channel RX4.

In this way, the second branch 72 is connected to the third reception channel RX3 at the second frequency band $f_2$ and the fourth branch 74 is connected to the fourth reception channel RX4 at the second frequency band $f_2$. Furthermore, the sixth branch 75 is connected to the third reception channel RX3 at the first frequency band $f_1$, and the eighth branch 78 is connected to the fourth reception channel RX4 at the first frequency band $f_1$.

This means that as a total there are two transmission channels TX1, TX2 and four reception channels RX1, RX2, RX3, RX4. By means of the diplexers 40, 41, 44, 45, reception of two different frequency bands $f_1$, $f_2$ is possible for each set of subarrays 4, 5, 6, 7. For each antenna column 2, 3, the two sets of subarrays 4, 5, 6, 7 receive on different reception channels RX1, RX3; RX2, RX4 which enables polarization diversity. This is however not necessary for the present invention, but constitutes an advantageous configuration. It is, however, necessary that, for each diplexer 40, 41, 44, 45, one filter port 52, 54, 56, 58 is connected to both a reception channel and a transmission channel of one frequency band, and that the other filter port 53, 55, 57, 59 is connected to a reception channel of another frequency band.

By placing the two transmission channels TX1, TX2 for the first frequency band $f_1$ on the first antenna column 2 and the two transmission channels TX1, TX2 for the second frequency band $f_2$ on the second antenna column 3, individual tilt is achieved on downlink, which is important for limiting downlink interference between cells.

The additional third reception channel RX3 and fourth reception channel RX4 of the first frequency band $f_1$ will get the same tilt as the transmission channels TX1, TX2 for second frequency band $f_2$, and vice versa. This has a limited system impact regarding the total reception performance assuming that the tilt settings between the first frequency band $f_1$ and the second frequency band $f_2$ are not completely different.

The present invention is not limited to the above, but may vary within the scope of the appended claims. For example, it is conceivable that there only is one antenna column. In the least complicated form of the present invention, each antenna column comprises at least two subarrays, where each subarray comprises one antenna element.

The polarizations may have any directions, but should always be orthogonal.

When terms like orthogonal and parallel are used, these terms are not to be interpreted as mathematically exact, but within what is practically obtainable.

The first antenna elements 8, 16 and the second antenna elements 9, 17 of the first subarrays 4*a*, 5*a* of the first antenna column 2 are shown as separate antenna elements, but are practically often combined into two respective dual polarized antenna elements that share the same physical location, for example in the form of a cross. In the same way, in all opposing sets of subarrays 4*a*, 5*a*; 4*b*; 5*b*; 4*c*, 5*c*; 4*d*; 5*d*; 6*a*, 7*a*; 6*b*, 7*b*; 6*c*, 7*c*; 6*d*, 7*d* the antenna elements may form dual polarized antenna elements, each dual polarized antenna element 4*a*, 4*b*, 4*c*, 4*d*; 5*a*, 5*b*, 5*c*, 5*d* being arranged for transmission and reception of the first polarization P1 and the second polarization P2.

The polarizations P1, P2 are shown to be perpendicular to the schematically indicated antenna elements 8, 9; 10, 11; 12, 13; 14, 15; 16, 17; 18, 19; 20, 21; 22, 23; 24, 25; 26, 27; 28, 29; 30, 31; 32, 33; 34, 35; 36, 37; 38, 39, which is the case for antenna elements in the form of slots, but this is only by way of example. For dipole antenna elements, the polarizations P1, P2 are parallel to the antenna elements, and for patch antenna elements, the polarization runs in a direction along the patch in dependence of its feeding.

In the above, the term branch 71, 72, 73, 74, 75, 76, 77, 78 may comprise several signal connections. The transmission channels TX and reception channels TX may be regarded as transmission branches and reception branches corresponding to said signal connections.

The phase shifters 42, 43; 46, 47 may be constituted by any suitable phase altering devices, and the diplexers 40, 41; 44, 45 may be constituted by any suitable filter devices.

Generally, the antenna arrangement 60 comprises at least one antenna column 2, 3, each antenna column 2, 3 comprising a first set of subarrays 4; 6 and a second set of subarrays 5; 7. Each set of subarrays 4, 5; 6, 7 comprises at least two subarrays 4*a*, 4*b*, 4*c*, 4*d*; 5*a*, 5*b*, 5*c*, 5*d*; 6*a*, 6*b*, 6*c*, 6*d*; 7*a*, 7*b*, 7*c*, 7*d*, and each subarray 4*a*, 4*b*, 4*c*, 4*d*; 5*a*, 5*b*, 5*c*, 5*d*; 6*a*, 6*b*, 6*c*, 6*d*; 7*a*, 7*b*, 7*c*, 7*d* in turn comprises at least one antenna element 8, 9; 10, 11; 12, 13; 14, 15; 16, 17; 18, 19; 20, 21; 22, 23; 24, 25; 26, 27; 28, 29; 30, 31; 32, 33; 34, 35; 36, 37; 38, 39. The first set of subarrays 4; 6 comprises antenna elements 8, 9; 10, 11; 12, 13; 14, 15; 24, 25; 26, 27; 28, 29; 30, 31 having the first polarization P1, and the second set of subarrays 5; 7 comprises antenna elements 16, 17; 18, 19; 20, 21; 22, 23; 32, 33; 34, 35; 36, 37; 38, 39 having the second polarization P2.

Each first set of subarrays 4; 6 is connected to a corresponding first filter device 40, 44 via a first corresponding phase altering device 42, 46, and each second set of subarrays 5; 7 is connected to a corresponding second filter device 41, 45 via a second corresponding phase altering device 43, 47. Each filter device 40, 41; 44, 45 has a respective combined port 48, 49, 50, 51 connected to the corresponding phase altering device 42, 43; 46, 47 and is associated with signals at the first frequency band $f_1$ and signals at the second frequency band $f_2$. Each filter device 40, 41; 44, 45 further has a respective first filter port 52, 54; 56, 58 and a respective second filter port 53, 55; 57, 59. Each filter device 40, 41; 44, 45 is arranged to separate signals at the first frequency band $f_1$ and signals at the second frequency band $f_2$ between the respective combined port 48, 49, 50, 51 and the respective filter ports 52, 53, 54, 55; 56, 57, 58, 59, such that each first filter port 52, 54; 56, 58 is arranged for transmission and reception of signals at one frequency band and each second filter port 53, 55; 57, 59 is arranged for reception of signals at the other frequency band.

The invention claimed is:

1. A node in a wireless communication network, the node comprising:

an antenna arrangement comprising at least one antenna column, wherein the at least one antenna column comprises a first set of subarrays and a second set of subarrays, each set of subarrays comprises at least two subarrays, each subarray comprises at least one antenna element, said first set of subarrays comprises antenna elements having a first polarization, said second set of subarrays comprises antenna elements having a second polarization, the first polarization and the second polarization being mutually orthogonal, each first set of subarrays is connected to a corresponding first filter device via a first corresponding phase altering device, each second set of subarrays is connected to a corresponding second filter device via a second corresponding phase altering device, each filter device has a respective combined port connected to the corresponding phase altering device and is associated with signals at a first frequency band and signals at a second frequency band, said frequency bands being spectrally separated from each other, each filter device further has a respective first filter port and a respective second filter port, each filter device is arranged to separate signals at the first frequency band and signals at the second frequency band between the respective combined port and the respective filter ports such that each first filter port is arranged for transmission and reception of signals at one frequency band, and each second filter port is arranged for reception of signals at the other frequency band.

2. The node according to claim 1, wherein the node comprises a first antenna column and a second antenna column, the antenna columns being physically separated from each other.

3. The node according to claim 2, wherein the antenna columns have respective main extensions in an elevation direction.

4. The node according to claim 3, wherein the antenna columns are separated in either an azimuth direction or the elevation direction, the azimuth direction and the elevation direction being mutually orthogonal.

5. The node according to claim 1, wherein for each antenna column, the first filter ports are connected to different transmitter channels.

6. The node according to claim 5, wherein there is a first transmitter channel and a second transmitter channel, the first transmission channel being associated with the first polarization and the second transmission channel being associated with the second polarization.

7. The node according to claim 1, wherein for each antenna column, the first filter ports are connected to different reception channels, and that the second filter ports are connected to different reception channels.

8. The node according to claim 1, wherein each filter device is constituted by a diplexer.

9. The node according to claim 1, wherein the phase shifting devices are arranged to control the phase of the subarrays such that an electrical steering of an antenna radiation main lobe of said antenna column is enabled.

10. The node according to claim 1, wherein the first phase altering device includes a subarray port for each subarray in the first set of subarrays, and each subarray in the first set of subarrays is individually connected to a respective subarray port of the first phase altering device.

11. The node according to claim 10, wherein the second phase altering device includes a subarray port for each subarray in the second set of subarrays, and each subarray in the second set of subarrays is individually connected to a respective subarray port of the second phase altering device.

* * * * *